US011549688B2

(12) United States Patent
Duffy et al.

(10) Patent No.: US 11,549,688 B2
(45) Date of Patent: Jan. 10, 2023

(54) ANTI-ROTATION FEATURE FOR A BURNER

(71) Applicant: WHIRLPOOL CORPORATION, Benton Harbor, MI (US)

(72) Inventors: Patrick J. Duffy, St. Joseph, MI (US); Ken E. Johnson, Owasso, OK (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 233 days.

(21) Appl. No.: 16/390,556

(22) Filed: Apr. 22, 2019

(65) Prior Publication Data

US 2020/0333012 A1 Oct. 22, 2020

(51) Int. Cl.

| | |
|---|---|
| ***F24C 3/08*** | (2006.01) |
| ***F23D 14/46*** | (2006.01) |
| ***F23N 1/00*** | (2006.01) |
| ***F23D 14/06*** | (2006.01) |
| *F23Q 3/00* | (2006.01) |
| *F23R 3/60* | (2006.01) |

(52) U.S. Cl.

CPC ..... *F24C 3/085* (2013.01); *F23D 14/06* (2013.01); *F23D 14/46* (2013.01); *F23N 1/007* (2013.01); *F23D 2900/14064* (2013.01); *F23Q 3/006* (2013.01); *F23R 3/60* (2013.01)

(58) Field of Classification Search

CPC .. F24C 3/085; F24C 3/082; F24C 3/10; F23N 1/007; F23Q 3/006; Y10T 279/17863; Y10T 279/17; Y10T 279/17888; F23D 2900/00017; F23D 2900/14001; F23D 14/46; F23D 2900/14064; F16M 2200/024; F16M 2200/028; F16M 2200/08

USPC ..... 126/39 E

See application file for complete search history.

(56) References Cited

U.S. PATENT DOCUMENTS

| | | | | |
|---|---|---|---|---|
| 3,547,592 | A | 12/1970 | Gladu et al. | |
| 5,915,956 | A | 6/1999 | Kwiatek et al. | |
| 6,318,993 | B1 * | 11/2001 | Huang | F23D 14/06 126/39 R |
| D470,721 | S | 2/2003 | Home | |
| 7,527,495 | B2 | 5/2009 | Yam et al. | |
| 9,022,780 | B2 | 5/2015 | Padgett | |
| 9,557,063 | B2 | 1/2017 | Cadima | |
| D790,274 | S | 6/2017 | Martin et al. | |

(Continued)

FOREIGN PATENT DOCUMENTS

| | | | |
|---|---|---|---|
| AU | 2014356822 | B2 | 6/2015 |
| CA | 2618038 | A1 | 8/2008 |

(Continued)

*Primary Examiner* — Steven B Mcallister
*Assistant Examiner* — Benjamin W Johnson
(74) *Attorney, Agent, or Firm* — Price Heneveld LLP

(57) ABSTRACT

A gas burner for a cooktop includes a spreader extending along a major axis to define an elongated shape. The spreader further defines an underside and includes a first projection and a second projection extending away from the underside. An orifice holder includes a body and a first lobe and a second lobe extending radially outward from the body. The first and second projections are opposingly adjacent to at least one of the first and second lobes. The orifice holder is mutually engageable with the spreader, with the first and second projections opposingly adjacent with at least one of the first and second lobes.

20 Claims, 14 Drawing Sheets

(56) References Cited

U.S. PATENT DOCUMENTS

| | | | | |
|---|---|---|---|---|
| 9,791,156 | B2 * | 10/2017 | Cadima | F24C 3/085 |
| 9,927,055 | B2 * | 3/2018 | Zonneveld | F16L 37/18 |
| 9,995,482 | B2 | 6/2018 | Cadima | |
| 10,036,557 | B2 | 7/2018 | Ceccoli | |
| 10,145,568 | B2 * | 12/2018 | Balderas | F24C 3/085 |
| 2002/0187450 | A1 | 12/2002 | Bondi et al. | |
| 2006/0196493 | A1 * | 9/2006 | Serenellini | F23D 14/065 126/39 E |
| 2013/0098742 | A1 * | 4/2013 | Bowen | F24C 7/082 200/336 |
| 2016/0025348 | A1 | 1/2016 | Cadima | |
| 2018/0023815 | A1 * | 1/2018 | Duffy | F24C 3/085 126/39 E |
| 2018/0100655 | A1 * | 4/2018 | Aguilar | F23D 14/64 |
| 2018/0172280 | A1 * | 6/2018 | Duffy | F24C 3/085 |
| 2018/0306448 | A1 * | 10/2018 | Cadima | F24C 3/085 |
| 2019/0145626 | A1 * | 5/2019 | Cadima | F23D 14/06 126/39 E |

FOREIGN PATENT DOCUMENTS

| | | | | |
|---|---|---|---|---|
| EP | 2232149 | A2 | 9/2010 | |
| KR | 20100048458 | A | 5/2010 | |
| WO | WO-2009078647 | A2 * | 6/2009 | F23D 14/06 |
| WO | D092248-0001 | | 12/2016 | |

* cited by examiner

ANTI-ROTATION FEATURE FOR A BURNER

BACKGROUND OF THE DISCLOSURE

The present disclosure generally relates to an anti-rotation feature, and more specifically, to an anti-rotation feature for a burner.

SUMMARY OF THE DISCLOSURE

According to one aspect of the present disclosure, a gas burner for a cooktop includes a spreader that extends along a major axis to define an elongated shape. The spreader further defines an underside and includes a first projection and a second projection that extend away from the underside. An orifice holder includes a body and a first lobe and a second lobe that extend radially outward from the body with the first and second projections opposingly adjacent to at least one of the first and second lobes. The orifice holder is mutually engageable with the spreader.

According to another aspect of the present disclosure, a burner for a cooktop includes a spreader defining an underside and including a first projection and a second projection. The first and the second projections extend away from the underside. A holder includes at least one lobe extending radially outward from the holder along a radial axis defining a first side and a second side of the at least one lobe. The holder is mutually engageable with the spreader including by positioning of the first and second projections opposingly adjacent the at least one lobe.

According to yet another aspect of the present disclosure, a cooktop includes an upper housing that defines an exterior, an interior, and an aperture. A spreader is positioned on the upper housing and defines an underside resting on the exterior of the upper housing. The spreader also includes a plurality of projections extending away from the underside and aligned with the aperture of the upper housing. A holder is rigidly affixed on the interior of the upper housing and includes at least one lobe extending radially outward from the holder along a radial axis that divides the at least one lobe into a first side and a second side. The holder is mutually engageable with the spreader by positioning the projections adjacent the at least one lobe through the aperture.

These and other features, advantages, and objects of the present disclosure will be further understood and appreciated by those skilled in the art by reference to the following specification, claims, and appended drawings.

Figure 1:
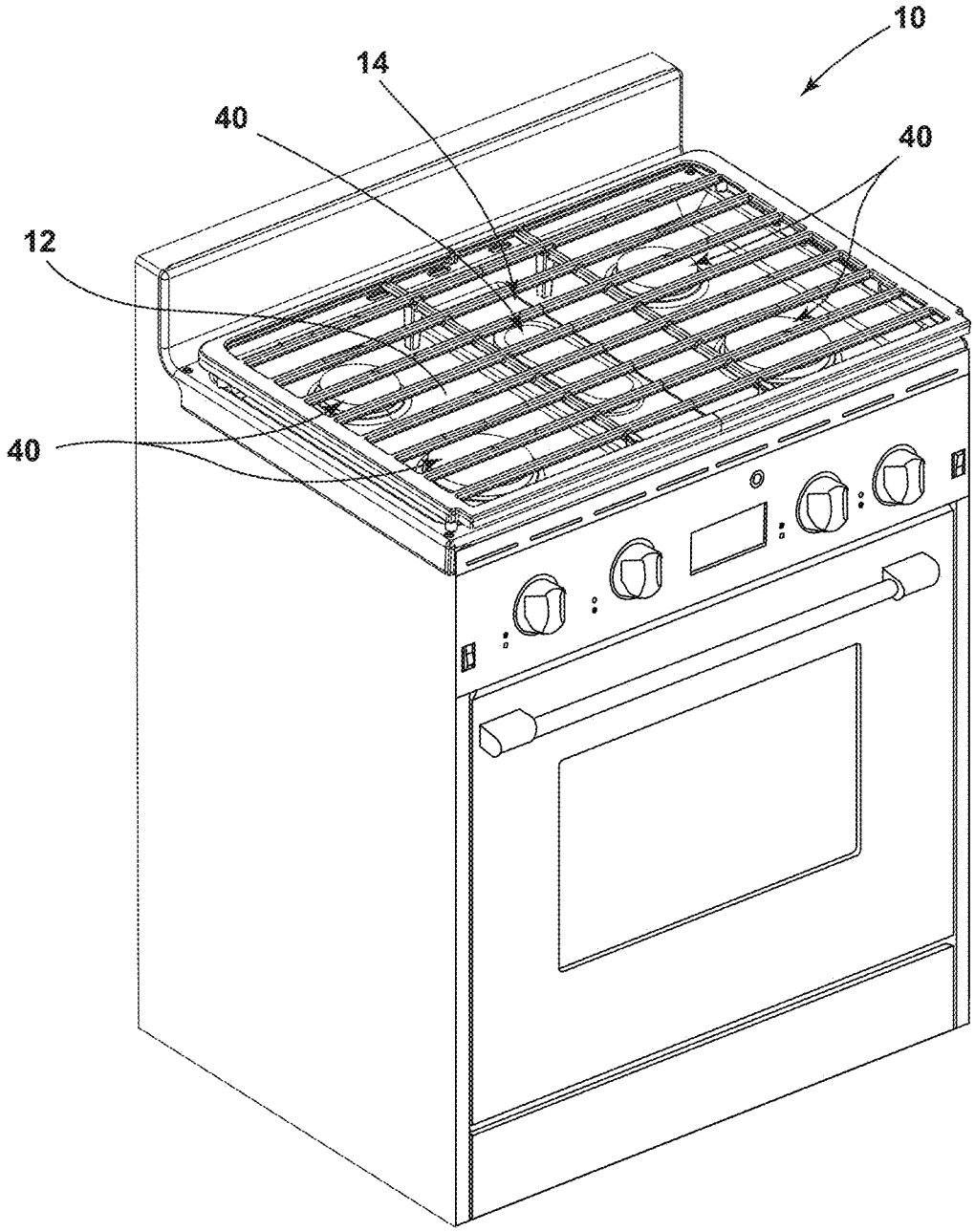
FIG. 1 is a top perspective view of a cooking appliance, according to at least one aspect of the disclosure.

The components in the figures are not necessarily to scale, emphasis instead being placed upon illustrating the principles described herein.

DETAILED DESCRIPTION

The present illustrated embodiments reside primarily in combinations of apparatus components related to an anti-rotation feature for a burner. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that article or apparatus that comprises a list of elements does not include only those elements but may include other elements not expressly listed or inherent to such article or apparatus. An element proceeded by "comprises a . . . " does not, without more constraints, preclude the existence of additional identical elements in the article or apparatus that comprises the element.

Referring to FIGS. 1-8, reference numeral 10 generally designates a cooking appliance including a cooktop 12 and a gas burner 14. The gas burner 14 includes a spreader 16 extending along a major axis 18 to define an elongated shape 20. The spreader 16 defines an underside 22 and includes projections 24. In the illustrated example, the projections 24 include a first projection 24*a* and a second projection 24*b* extending away from the underside 22. The cooktop 12 further includes an orifice holder 26 having a body 28 and lobes 30, which in the illustrated example, include a first lobe 32 and a second lobe 34 extending radially outward from the body 28 with the first and second projections 24*a*,24*b* opposingly adjacent to at least one of the first and second lobes 32,34. In at least this respect, the orifice holder 26 and the spreader 16 are mutually engageable.

Figure 2:
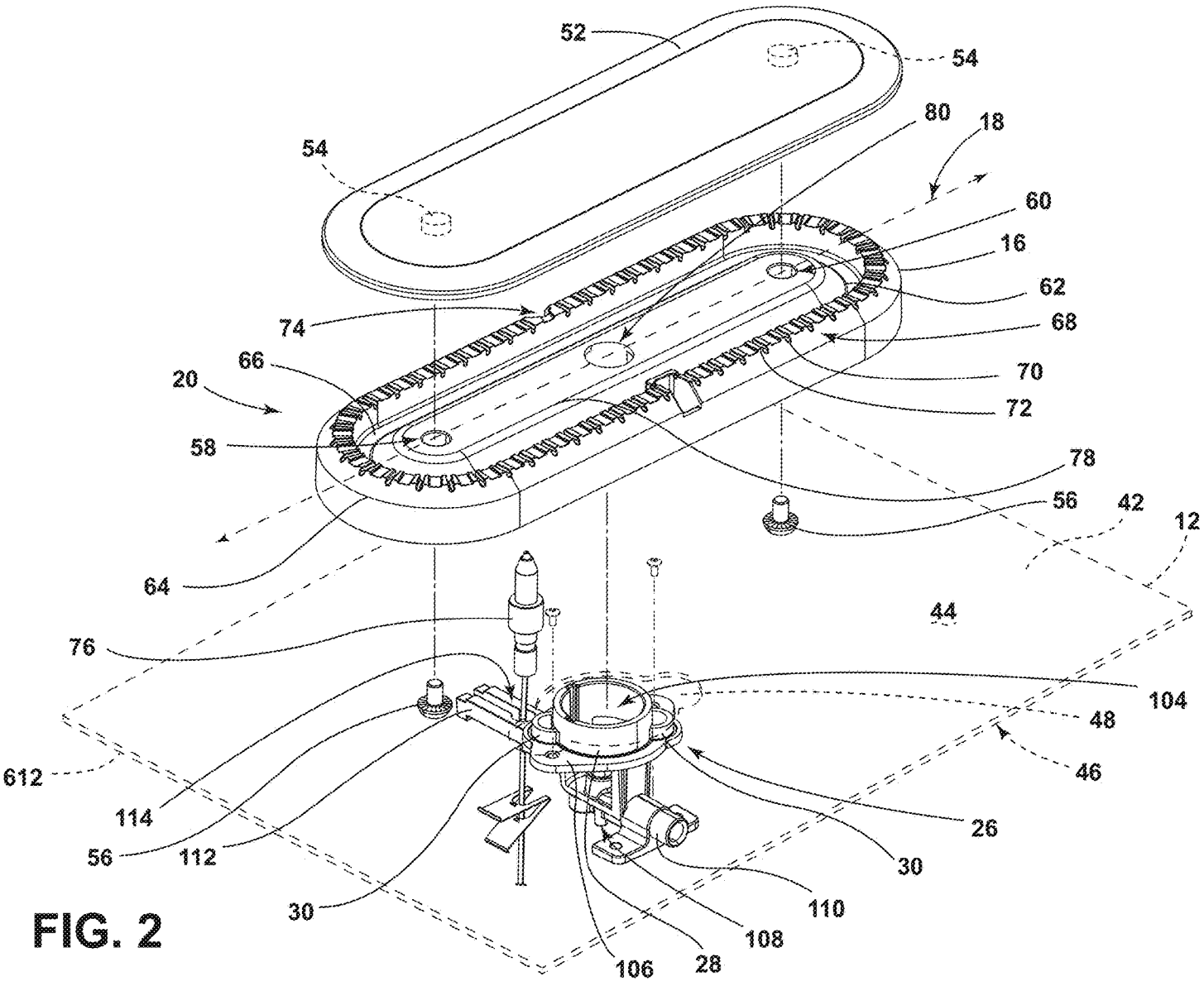
FIG. 2 is a top perspective exploded view of a gas burner from the cooking appliance of FIG. 1.

As further shown in FIGS. 1 and 2, the cooking appliance 10 includes the gas burner 14 centrally located on the cooktop 12. Alternatively, the gas burner 14 may be a plurality of burner assemblies 40 and may be individually positioned at any useful location along the cooktop 12. As illustrated, the cooktop 12 includes an upper housing 42 defining an exterior 44, an interior 46, and an aperture 48 positioned along the upper housing 42 at, for example, a center of the desired location of the spreader 16. As such, the spreader 16 may be centrally positioned on the exterior 44 of the upper housing 42 such that the projections 24 and the stem 50 (FIG. 3) of the spreader 16 may pass through, or at least align with, the aperture 48. Additionally, the orifice holder 26 may be rigidly affixed to the interior 46 of the upper housing 42. In this configuration, the spreader 16 engages with the orifice holder 26, and limits rotation, through the upper housing 42 with the projections 24 opposingly adjacent the lobes 30 of the orifice holder 26.

As further shown in FIG. 2, the illustrated gas burner 14 includes a burner cap 52, which may include receiving members 54 to mutually engage with fasteners 56 such that the burner cap 52 may be disposed above the spreader 16. The fasteners 56 may respectively extend through a first end opening 58 and a second end opening 60 defined by the spreader 16 such that the fasteners 56 may couple with the burner cap 52. Additionally, the fasteners 56 may securely couple the burner cap 52 to the spreader 16, for example, by screwing the fasteners 56 into the receiving members 54 of the burner cap 52. Alternatively, the receiving members 54 may be placed on the fasteners 56 such that the burner cap 52 may be easily removed and replaced above the spreader 16. With regard to the spreader 16, an inner perimeter 62 and an outer perimeter 64 are defined by the spreader 16 with a connecting portion 66 disposed therebetween. A burner crown 68 may be disposed along the outer perimeter 64, where the burner crown 68 defines a series of depressions 70 and spines 72 configured to provide outlets for the fuel/air mixture and further configured for substantially even distribution of the flames produced by the burner assembly 40. The outer perimeter 64 of the spreader 16 may further define a recess 74 configured to receive an igniter 76, which may be, by way of example, a spark-ignition electrode. The inner perimeter 62 may define a raised portion 78 that may provide structural variation to aid in the mixing of gas and air within an interior chamber defined between the burner cap 52 and the spreader 16. The first and second end openings 58,60 may be inward of the inner perimeter 62 and defined by the raised portion 78. A central primary fuel/air mix inlet 80 may be further defined within the raised portion 78 of the spreader 16 and the stem 50 of the spreader 16, where the stem 50 may engage with the orifice holder 26 to receive the fuel/air mix.

Figure 3:
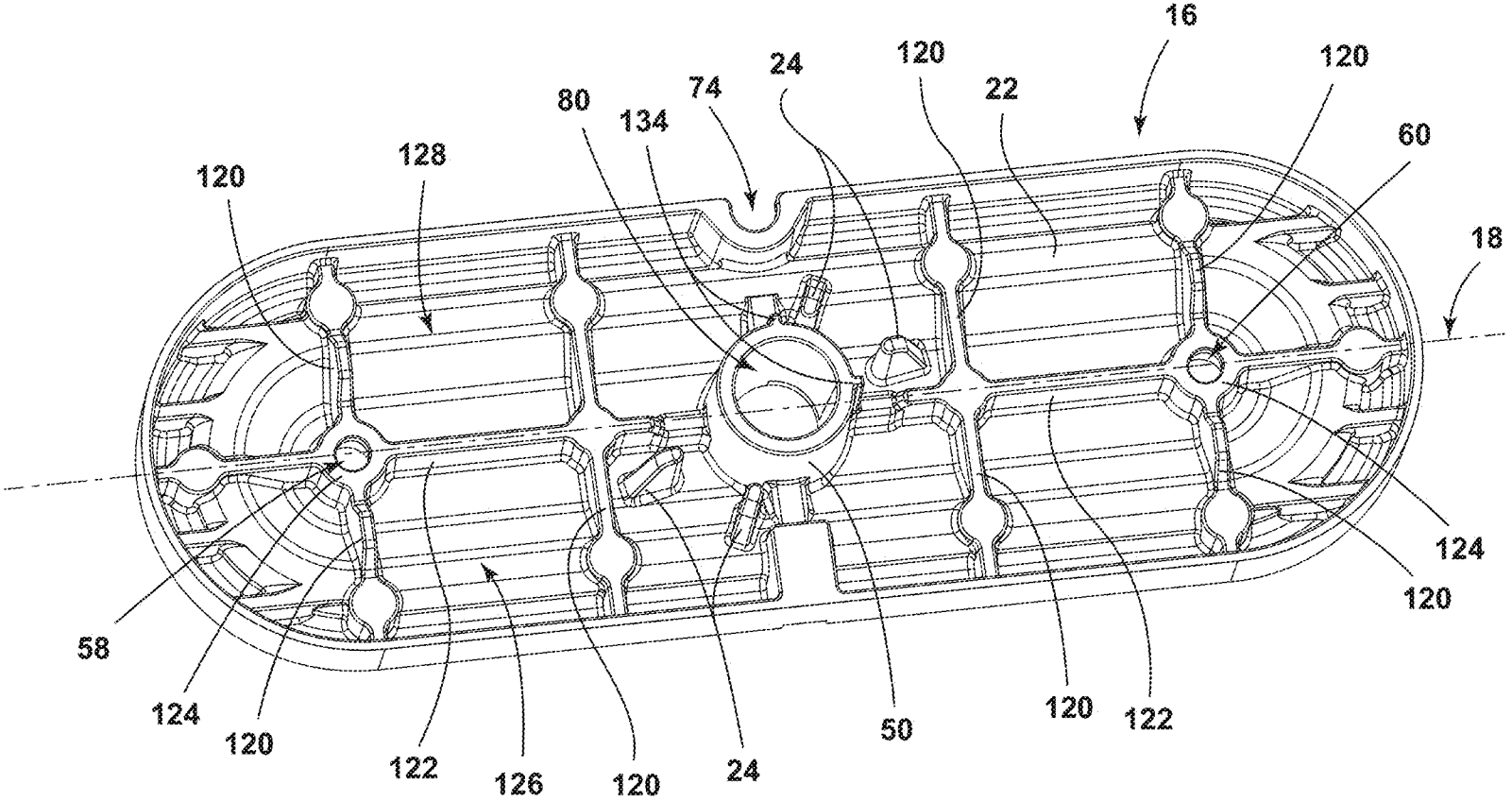
FIG. 3 is a bottom perspective view of a spreader of the gas burner.
Figure 5:
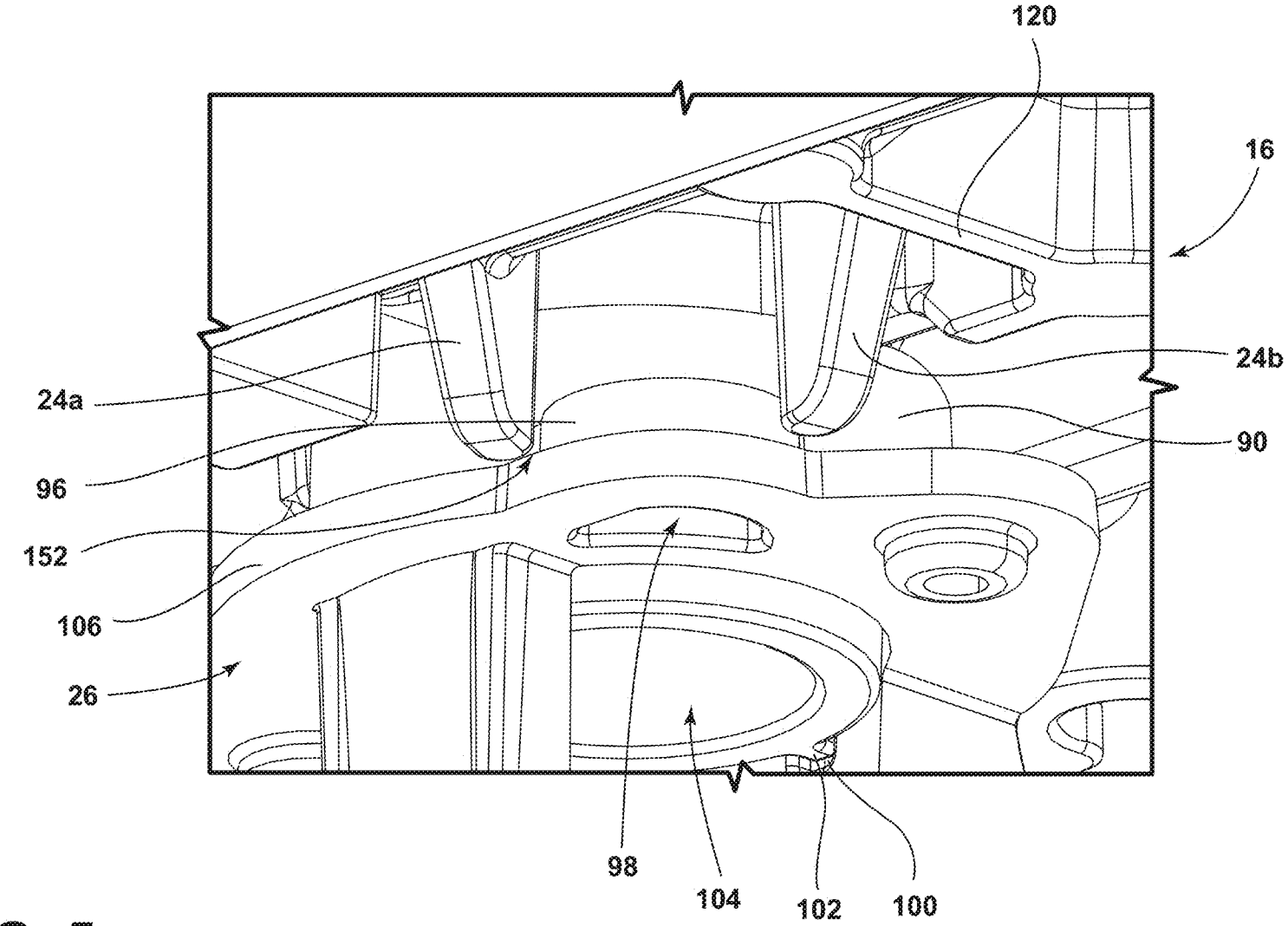
FIG. 5 is a partial bottom perspective view of the spreader and an associated holder for at least partially coupling the spreader to the cooking appliance.

Continuing with respect to FIG. 2, the above-mentioned lobes 30 extend radially from the body 28 of the orifice holder 26 along, and are divided by, respective radial axes 82 such that the first and second sides 84,86 of the lobes 30 are opposingly defined by the radial axes 82. Said another way, the geometry of the lobes has sides facing opposite directions from the respective radial axes 82. In a specific example, the lobes 30 are divided by a collinear axis 88 such that the lobes 30 are divided by a single axis with equal sides between evenly spaced lobes 30. Accordingly, the body 28 of the orifice holder 26 may also include side surfaces 90 that are divided by the collinear axis 88 defining first and second side surfaces 92,94 of the body 28. Rather than include the first and second lobes 32,34, the orifice holder 26 may include a single lobe 96, as shown in FIG. 5, extending radially outward from the body 28. As shown, the lobes 30 include a hollow portion 98; however, it will be understood by one having ordinary skill in the art that the lobes 30 may be generally rigid or solid. At least one groove 100 may be defined by the body 28, where the at least one groove 100 may be configured to receive a fin 102 defined by the stem 50 of the spreader 16, as shown in FIG. 3. The body 28 may further define a cavity 104 configured to direct gas flow in a generally upward direction to pass through the central primary fuel/air mix inlet 80 extending through the stem 50 of the spreader 16. The cavity 104 may be further defined by a flat surface 106 upon which the body 28 and the lobes 30 may be disposed. A base portion 108 may extend from the flat surface 106 and may include a gas injection port 110 and an elongated portion 112 defining a hole 114 configured to receive the igniter 76. Thus, the fuel supply may be directed through the base portion 108 and upward through the cavity 104 defined by the body 28 of the orifice holder 26 and the central primary fuel/air mix inlet 80 defined by the spreader 16. Additionally, open sides of the orifice holder 26 allow air to be drawn in to the body 28.

Figure 4:
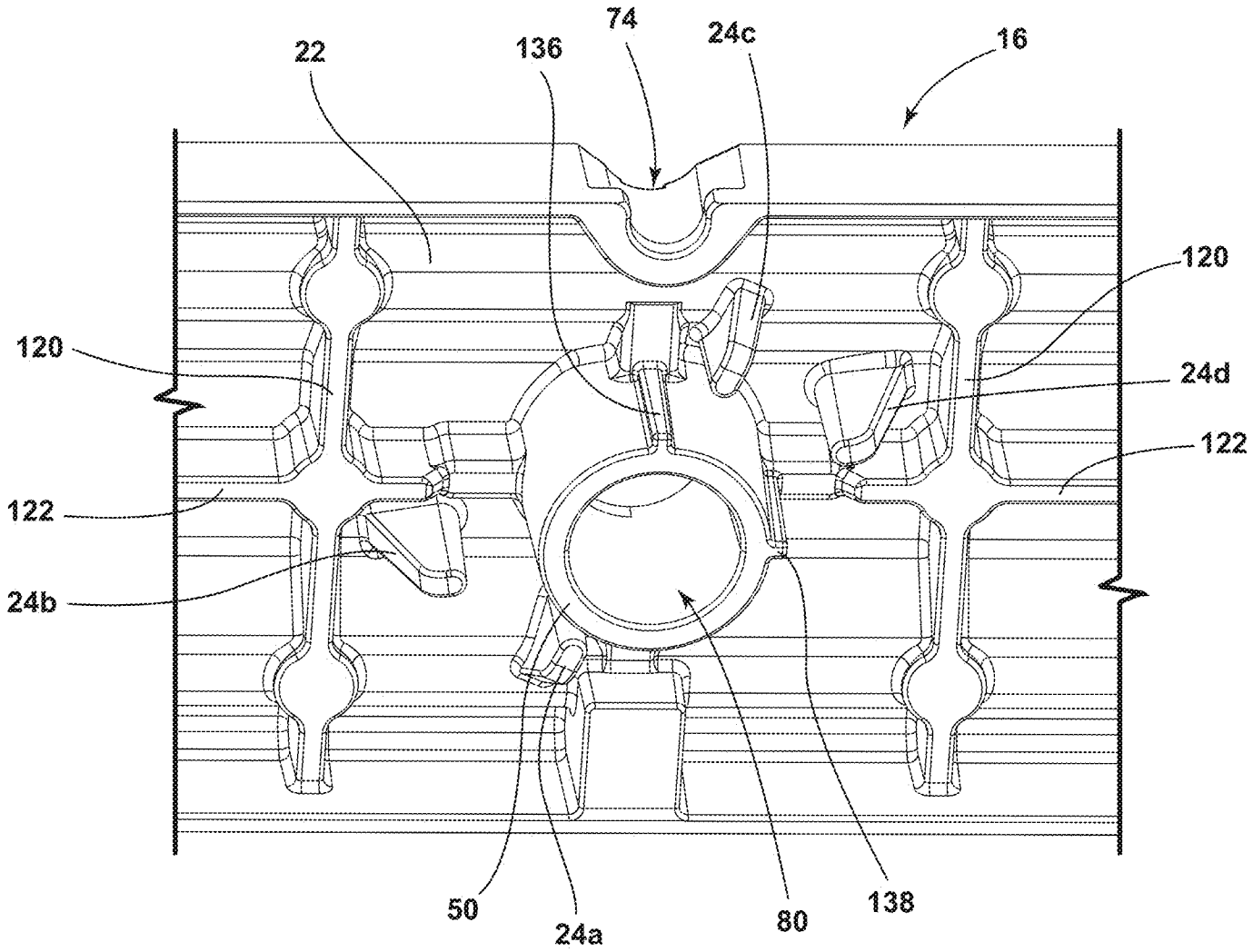
FIG. 4 is a partial bottom perspective view of the spreader of the gas burner.
Figure 6:
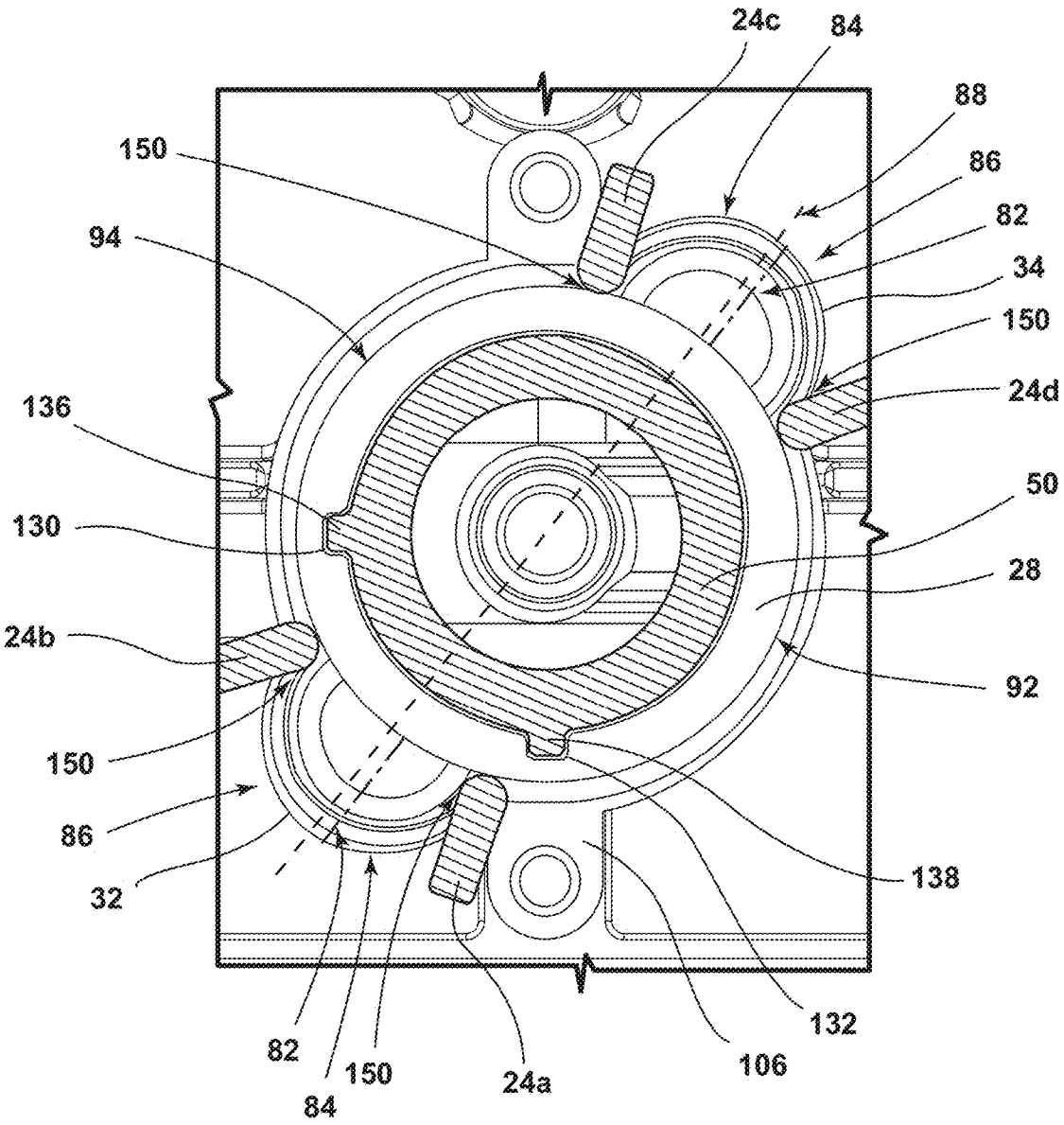
FIG. 6 is a partial top cross-section view of the holder and the spreader with respective portions thereof in mutual engagement.

As shown in FIGS. 3-5, the underside 22 of the spreader 16 may include transverse ribs 120 and longitudinal ribs 122, where the transverse ribs 120 may lie in a direction normal to the longitudinal ribs 122. The first and second end openings 58,60 may be further defined by a cross-section 124 at which the transverse ribs 120 and longitudinal ribs 122 intersect at lateral portions of the underside 22 of the spreader 16. Generally, the transverse and longitudinal ribs 120,122 may provide structural support for the spreader 16. As shown, the major axis 18 generally divides the underside 22 of the spreader 16 into first and second portions 126,128 such that the recess 74 is defined along the outer perimeter 64 of the first portion 126. Additionally as depicted, the longitudinal ribs 122 extend radially outward from the stem 50 along the major axis 18 further defining the first and second portions 126,128. However, it is generally contemplated that the longitudinal ribs 122 may be disposed on either the first or second portions 126,128 rather than along the major axis 18. As depicted in FIG. 6, the stem 50 is received within the cavity 104 defined by the body 28 of the orifice holder 26. The stem 50 may be generally held within the body 28 by engagement with a first groove 130 and a second groove 132 defined by the body 28 of the orifice holder 26. To achieve such engagement between the stem 50 and the body 28, the stem 50 may include a plurality of fins 134 including a first fin 136 and a second fin 138 configured to engage with the first and second grooves 130,132. Alternatively, the stem 50 may include a single fin 102 configured to couple with the groove 100 defined by the body 28 of the orifice holder 26. Despite the engagement between the first and second fins 136,138 and the first and second grooves 130,132, respectively, rotation of the spreader 16 relative the cooktop 12 may still occur.

As further shown in FIGS. 3 and 4, the underside 22 of the spreader 16 may also include the projections 24 such that at least two of the projections 24 are defined by the underside 22. In the present example, the projections 24, in addition to the above-mentioned first and second projections 24*a*,24*b*, include a third projection 24*c* and a fourth projection 24*d*. In this respect, it is noted that the projections 24 are discussed presently as including up to the fourth projection 24*d*, but it is generally contemplated that the projections 24 may include an indefinite quantity of at least two projections such that the projections 24 are not limited to four projections. As illustrated, the projections 24 are a generally oblique frustum shape; however, it will be understood that the projections 24 may also be in alternative shapes as desired to interact with the orifice holder 26, including lobes 30, consistent with the present disclosure. For example, the projections 24 may be a generally cylindrical or frustoconic shape akin to a pin. The projections 24 generally surround or are radially adjacent to the stem 50 where the spreader 16 is in the assembled position with the holder 26 depicted in FIGS. 4-8. In one example, the first and second projections 24*a*,24*b* may be on disposed on the first portion 126 of the underside 22 and the third and fourth projections 24*c*,24*d* may be disposed on the second portion 128 of the underside 22, although any positioning of the projections 24 that results in the opposing adjacency with the lobes 30 may be possible.

As further shown in FIG. 5, the first and second projections 24*a*,24*b* are opposingly adjacent the same single lobe 96 of the orifice holder 26. The lobes 30, including the single lobe 96, may have corner portions 150 (FIG. 6) where the lobes 30 intersect the side surfaces 90 of the body 28. The projections 24 may be positioned to be opposingly adjacent to the lobes 30 by contacting the orifice holder 26 at the respective corner portions 150. For example, the first and second projections 24*a*,24*b* may fit relative the corner portions 150 of the single lobe 96 such that the first and second projections 24*a*,24*b* may stabilize the spreader 16 relative the cooktop 12 to prevent rotation of the spreader 16 with relation to the cooktop 12 including by rotation of the stem 50 within the cavity 104. Although the projections 24 are shown in contact with the lobes 30 on opposite sides thereof, as described herein, projections 24 may be "opposingly adjacent" the lobes 30 such that a space 152 is present between the projections 24 and the lobes 30. Since the projections 24 may be opposingly adjacent the lobes 30, movement of the spreader 16 relative the upper housing 42 of the cooktop 12 may be limited to approximately one degree or less. The depicted configuration prevents the spreader 16 from shifting (including, at least, by rotation) relative to the cooktop 12 during use by positioning the single lobe 96 to obstruct or block movement of the projections 24 (and, therefore, the spreader 16) in opposing directions.

As shown in FIG. 6, the stem 50 is received within the orifice holder 26 with the projections 24 opposingly adjacent the lobes 30. As used herein, the term "opposingly adjacent" can be used to describe the positioning of the projections 24 with relation to at least one respective lobe 30 in that two of the projections 24 can be opposingly adjacent at least one respective lobe 30 when rotation of the spreader 16 in opposite directions brings a corresponding one of the two projections 24 into contact with, or increases a contact force against, the at least one lobe 30. In this manner, the illustrated first and second projections 24*a*,24*b* are opposingly adjacent the first lobe 32 by being respectively adjacent the first and second side surfaces 92,94 of the body 28. The third and fourth projections 24*c*,24*d* are, similarly, opposingly adjacent the second lobe 34 by being respectively adjacent the first and second side surfaces 92,94 of the body 28 thereof. In the present example, the first projection 24*a* is opposingly adjacent the first lobe 32 on the first side surface 92 of the body 28, and the second projection 24*b* may be opposingly adjacent the first lobe 32 on the second side surface 94 of the body 28. Further, the first and fourth projections 24*a*,24*d* are positioned on the first side surface 92 of the body 28 and the second and third projections 24*b*,24*c* are positioned on the second side surface 94 of the body 28. Based on the above, it can be appreciated that other arrangements are possible. In this respect, it is noted that the order of the projections 24 as described above is for reference only and is not limiting as to the order in which the projections 24 may be opposingly adjacent the lobes 30 or respective locations or constructions thereof.

Figure 7:
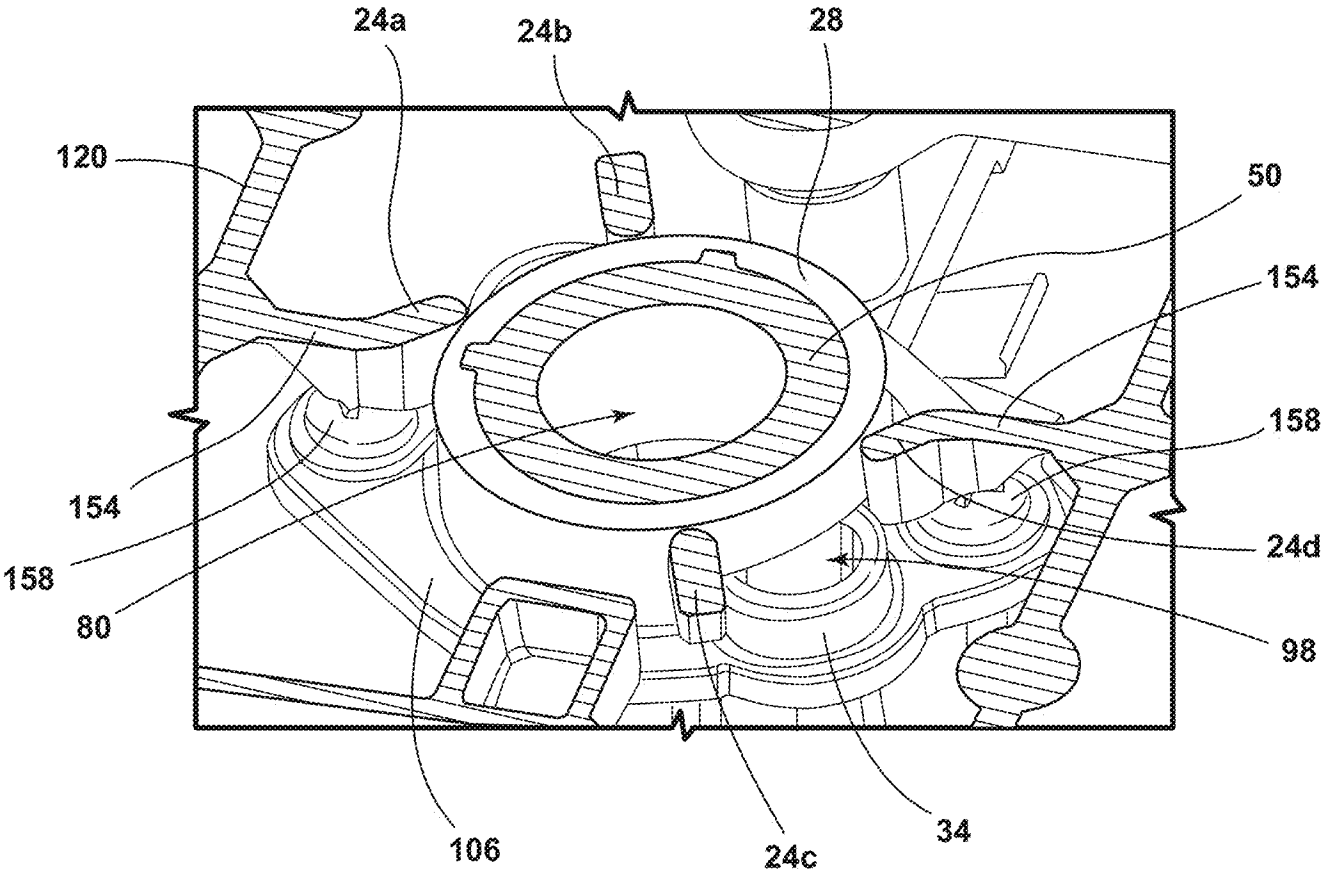
FIG. 7 is a partial top perspective cross-section view of the holder and spreader.
Figure 8:
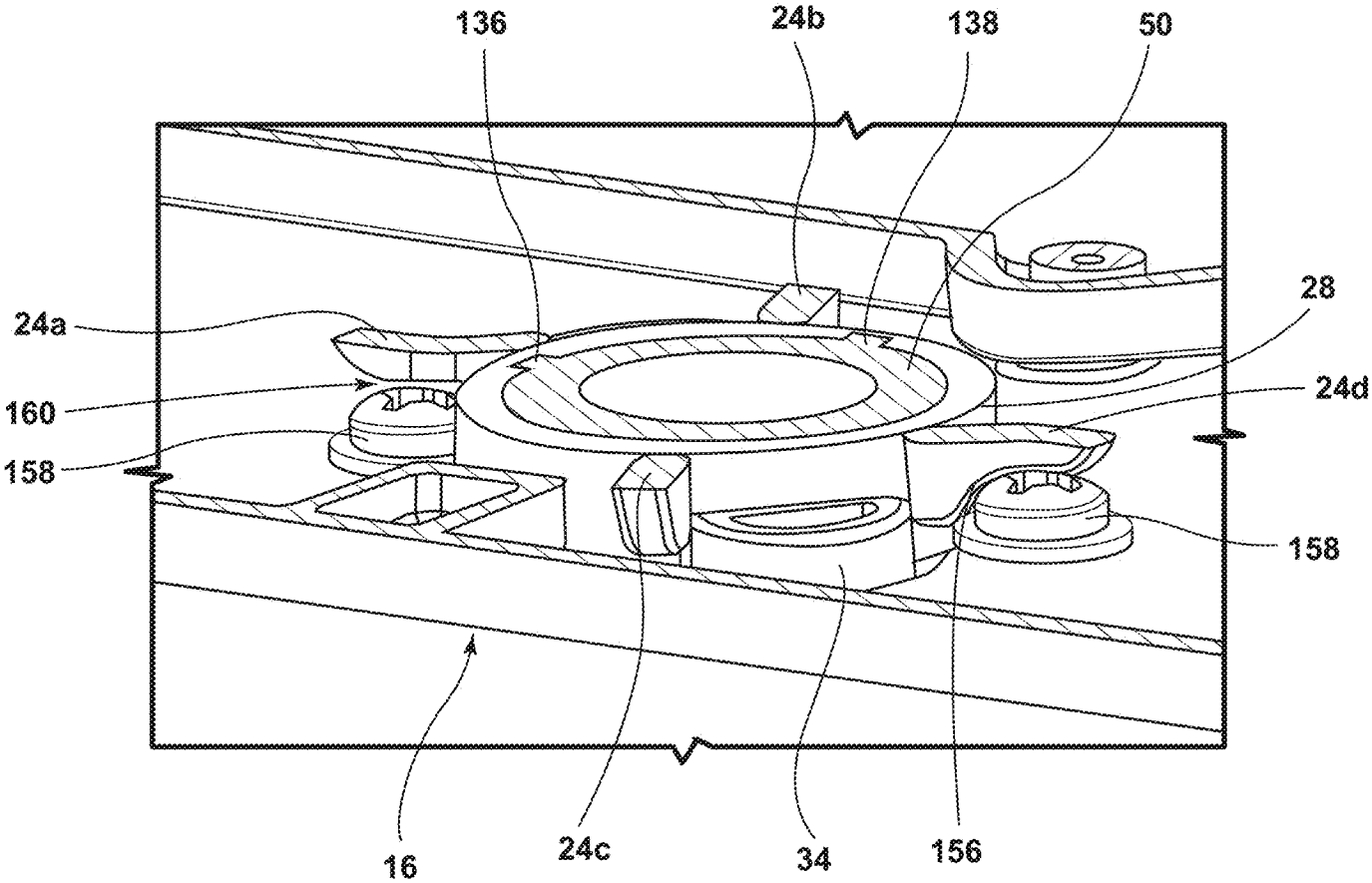
FIG. 8 is a partial side perspective view of the spreader.

As further shown in FIGS. 7 and 8, the projections 24 may extend from the longitudinal ribs 122 or the projections 24 may extend from the underside 22 of the spreader 16 such that the projections 24 lie between the transverse and longitudinal ribs 120,122. For exemplary purposes, FIG. 7 depicts the first and fourth projections 24*a*,24*d* as extending from the longitudinal ribs 122 to form curved projections 154. These curved projections 154 may be a generally L-shape or another shape, as desired to integrally connect the projections 24 to one of the longitudinal ribs 122, given the position of the longitudinal ribs 122 and the desired positioning and orientation of the projections 24. As discussed above in relation to FIG. 6, the designation of the curved projections 154 (i.e., the first and fourth projections 24*a*,24*d*) is merely exemplary such that the projections 24 may be structured and, accordingly, designated as any of the curved projections 154. Any of the projections 24 may further include an arcuate bottom edge 156, which may allow the curved projections 154 to be disposed above securing members 158 on the flat surface 106 of the orifice holder 26. The projections 24 may be disposed in such a manner that when the stem 50 of the spreader 16 is received in the cavity 104 of the orifice holder 26 there may be a gap 160 between the projections 24 and the flat surface 106 of the orifice holder 26.

Figure 9:
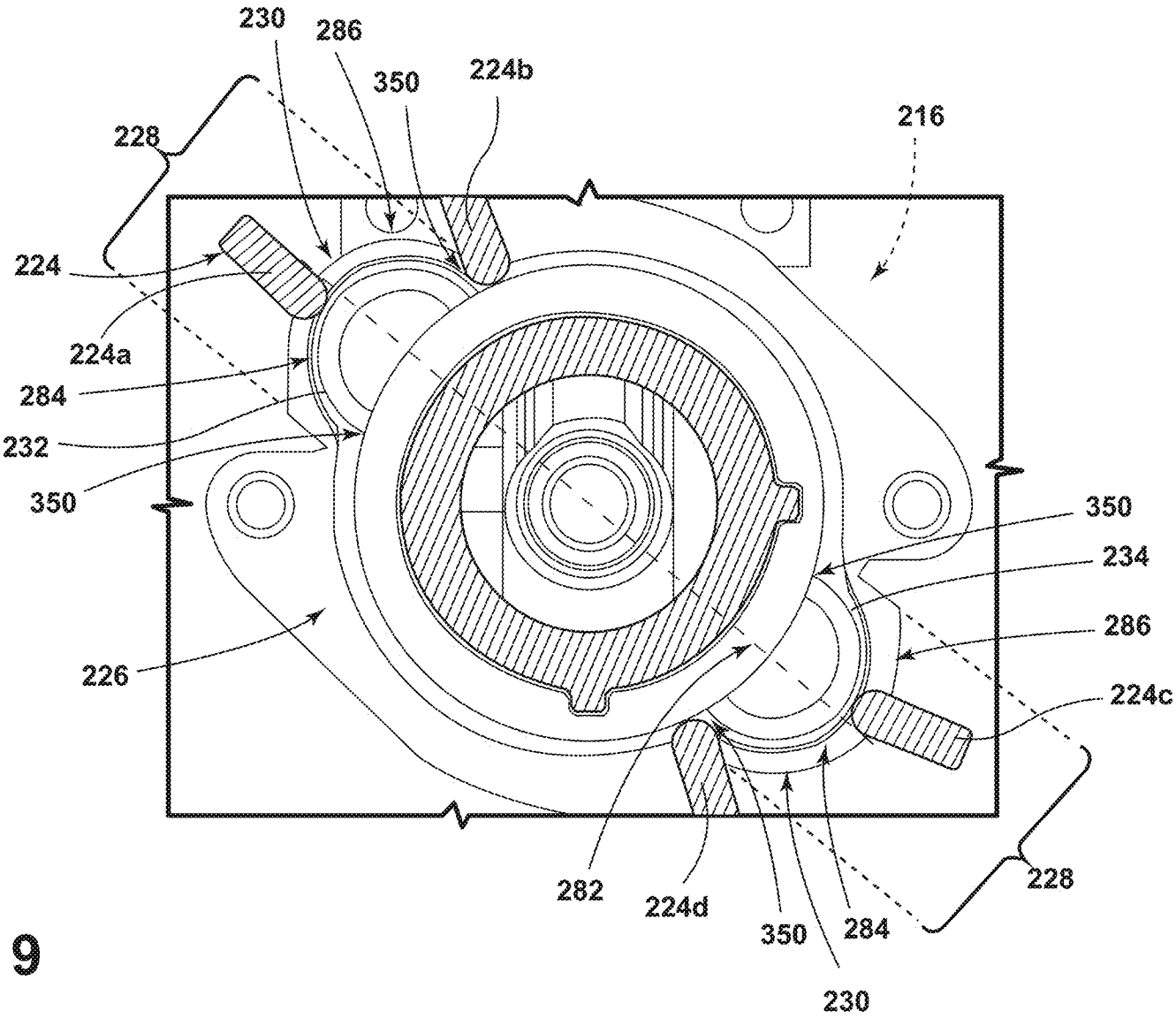
FIG. 9 is a partial top cross-section view of a variation of the spreader and the holder with portions thereof in mutual engagement.
Figure 10:
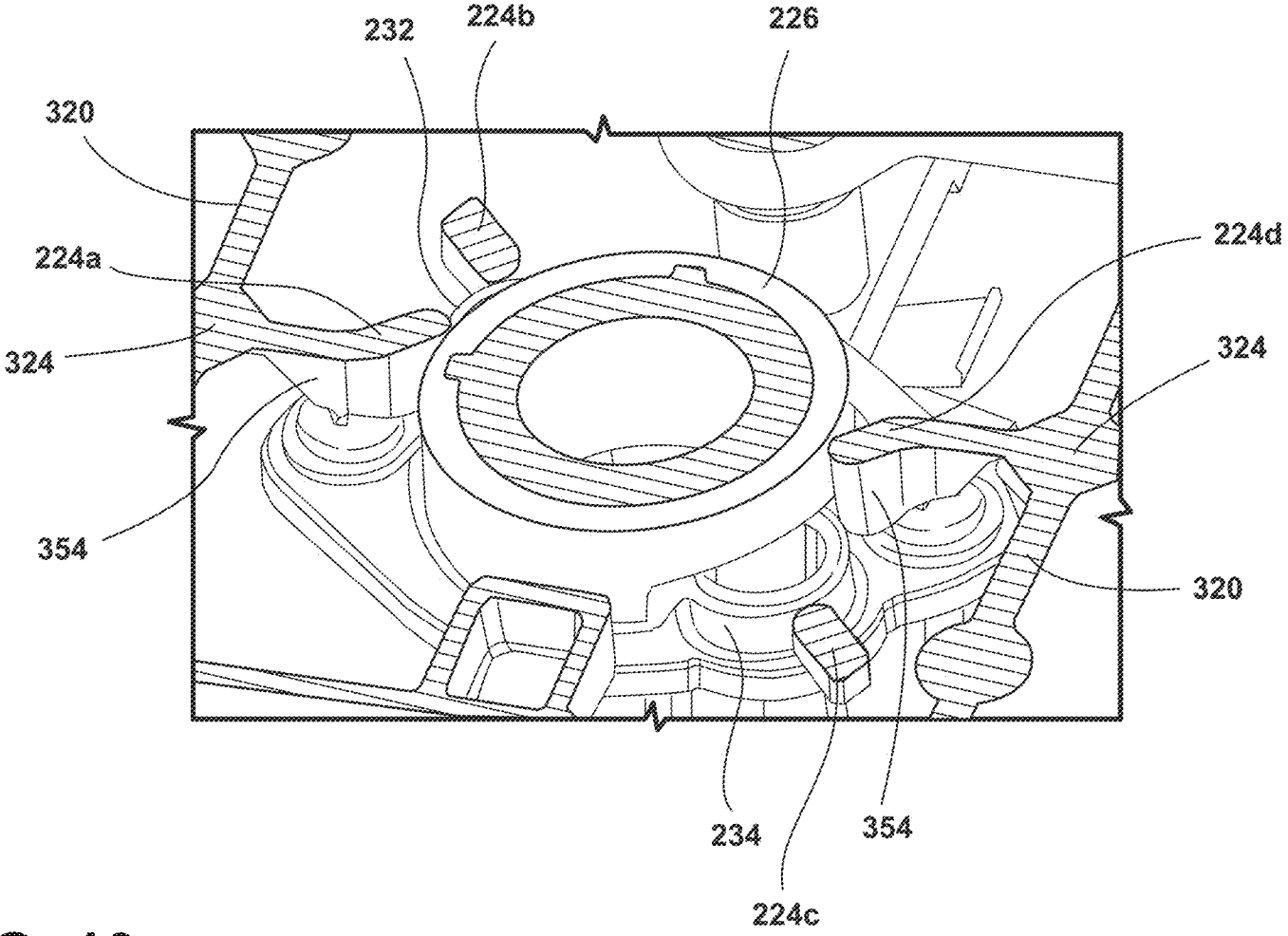
FIG. 10 is a partial top cross-section perspective view of the holder and the spreader of FIG. 9.

FIGS. 9 and 10 show a further example of a spreader 216 that is generally similar to the spreader 16 of FIGS. 1-8, except as discussed herein (with similar features indicated by similar numbers increased by 200), and is configured to engage with a holder 226 that is similar or identical to the orifice holder 26 of FIGS. 1-8. As illustrated, projections 224 are arranged so a first and third projections 224*a*,224*c* are opposingly adjacent an apex region 228 of first and second lobes 232,234, respectively, while second and fourth projections 224*b*,224*d* are shown as opposingly adjacent the corner portions 350 of first and second lobes 232,234, respectively. In the present example, the first and third projections 224*a*,224*c* are positioned on first and second sides 284,286, respectively, of the respective lobes 232,234 so as to still be opposingly adjacent the first and second lobes 232,234 with respect to the second and fourth projections 224*b*,224*d*. However, the construction of the spreader 216, as depicted, is not limited to the designation as shown. As discussed above, the projections 224 may be designated in any order along the holder 226 and in relation to either lobes 230. As illustrated in FIG. 10, the curved projections 354, designated as the second and fourth projections 224*b*, 224*d*, are adjacent the corner portions 350 of the lobes 230 and the first and third projections 224*a*,224*c* are adjacent the apex region 228 of the lobes 230. The second and fourth projections 224*b*,224*d* may be circumferentially positioned along the apex region 228 of the first and second lobes 232,234 such the second and fourth projections 224*b*,224*d* may be equally, yet oppositely, spaced from the radial axes 282. Alternatively, the second and fourth projections 224*b*, 224*d* may circumferentially positioned along the apex region 228 without being diametrically opposed. The curved projections 354, similarly depicted in FIG. 7, may extend from the longitudinal rib 322 at the cross-section 324 of the transverse and longitudinal ribs 320,322.

Figure 11:
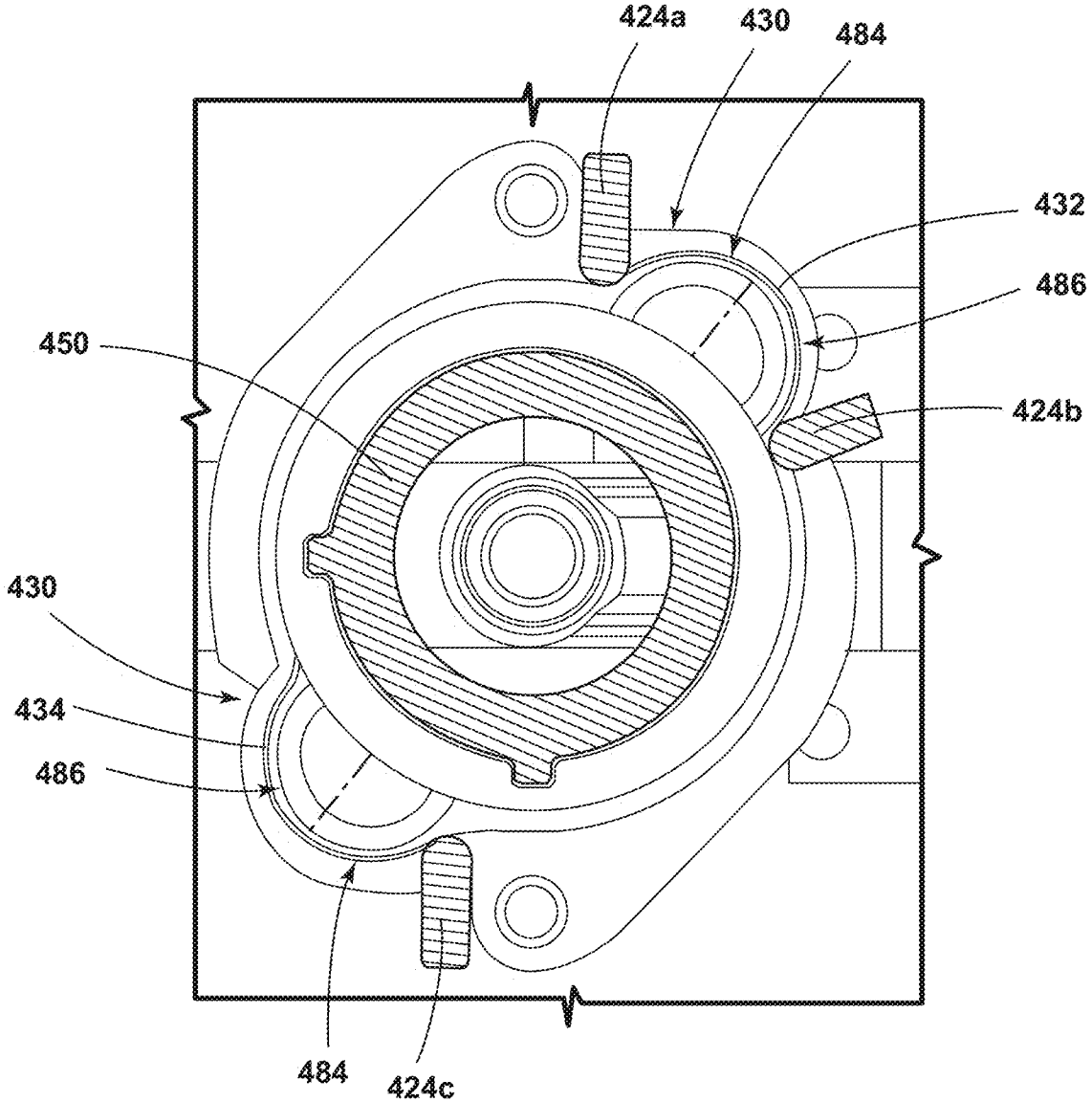
FIG. 11 is a partial top cross-section view of a still further variation of a spreader and holder with portions thereof in mutual engagement.
Figure 12:
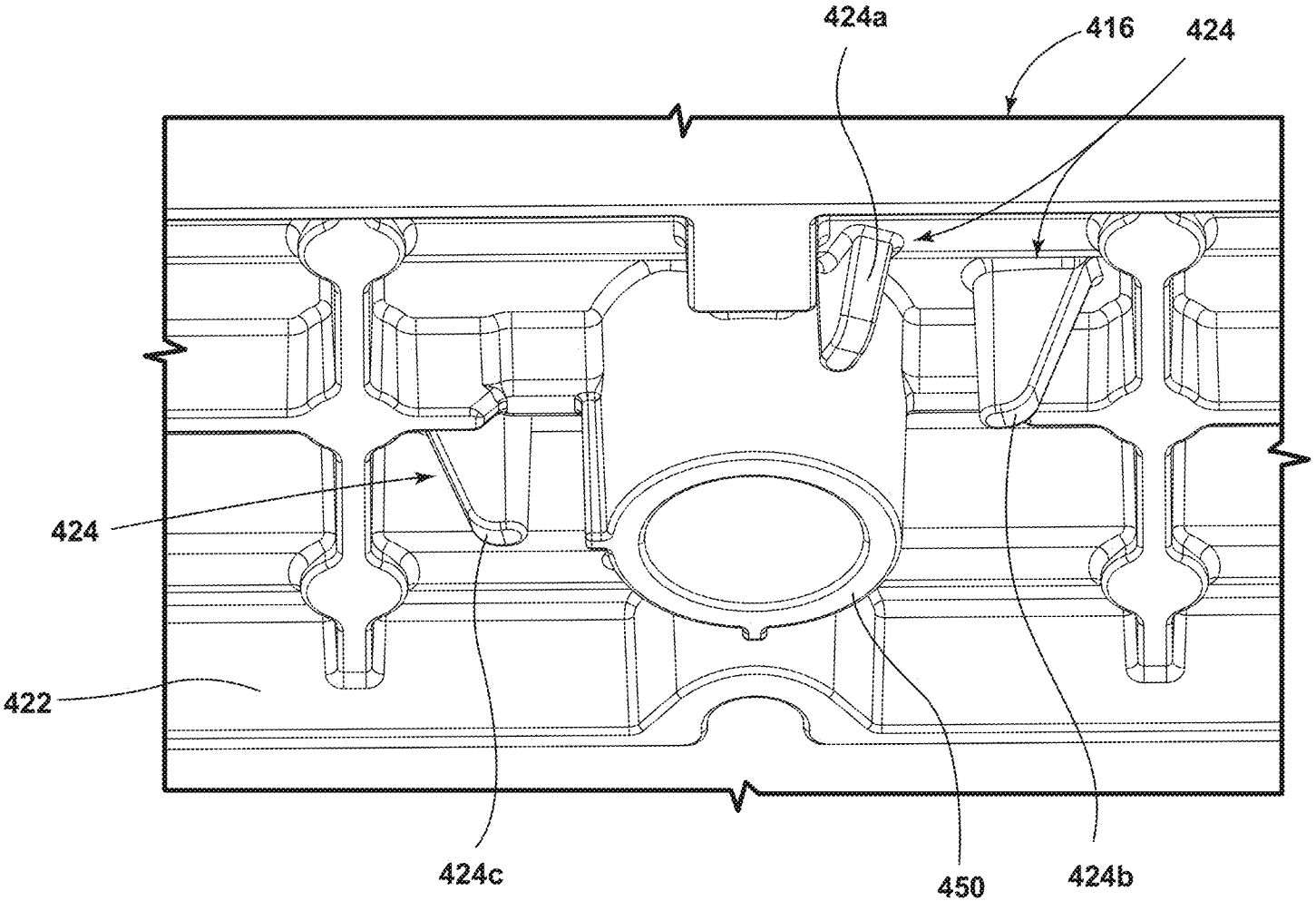
FIG. 12 is a partial bottom perspective view of the spreader of FIG. 11, the spreader and the holder having respective portions thereof in mutual engagement.

As further shown in FIGS. 11 and 12 in a further example, first, second, and third projections 424*a*,424*b*,424*c* may be opposingly adjacent lobes 430 such that the first and second projections 424*a*,424*b* may be opposingly adjacent the first lobe 432 in a similar manner to the previously described examples (with similar features indicated by similar numbers increased by 400). Additionally, the second and third projections 424*b*,424*c* may be opposingly adjacent the first and second lobes 432,434, respectively, by way of their positioning against the respective facing sides 484,486. Although the third projection 424*c* is illustrated as being on, for example, a first side 484 of the second lobe 434, it is generally contemplated that the third projection 424*c* may be on either the first or the second sides 484,486 of the second lobe 434. In such configurations, the projections 424 may extend away from the underside 422 of the spreader 416 radially proximate the stem 450.

Figure 13:
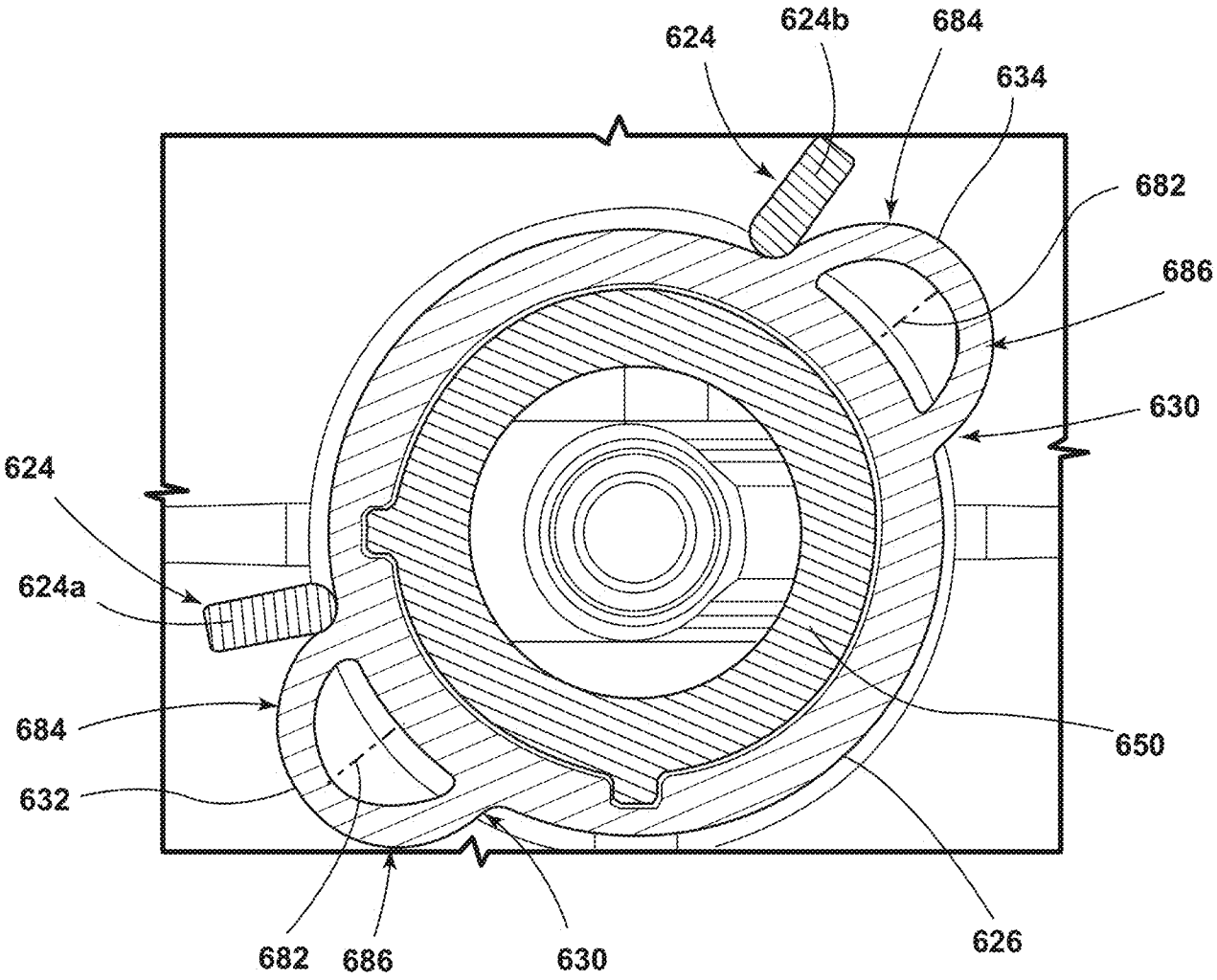
FIG. 13 is a partial top cross-section view of the a still further variation of a spreader and holder with portions thereof in mutual engagement.
Figure 14:
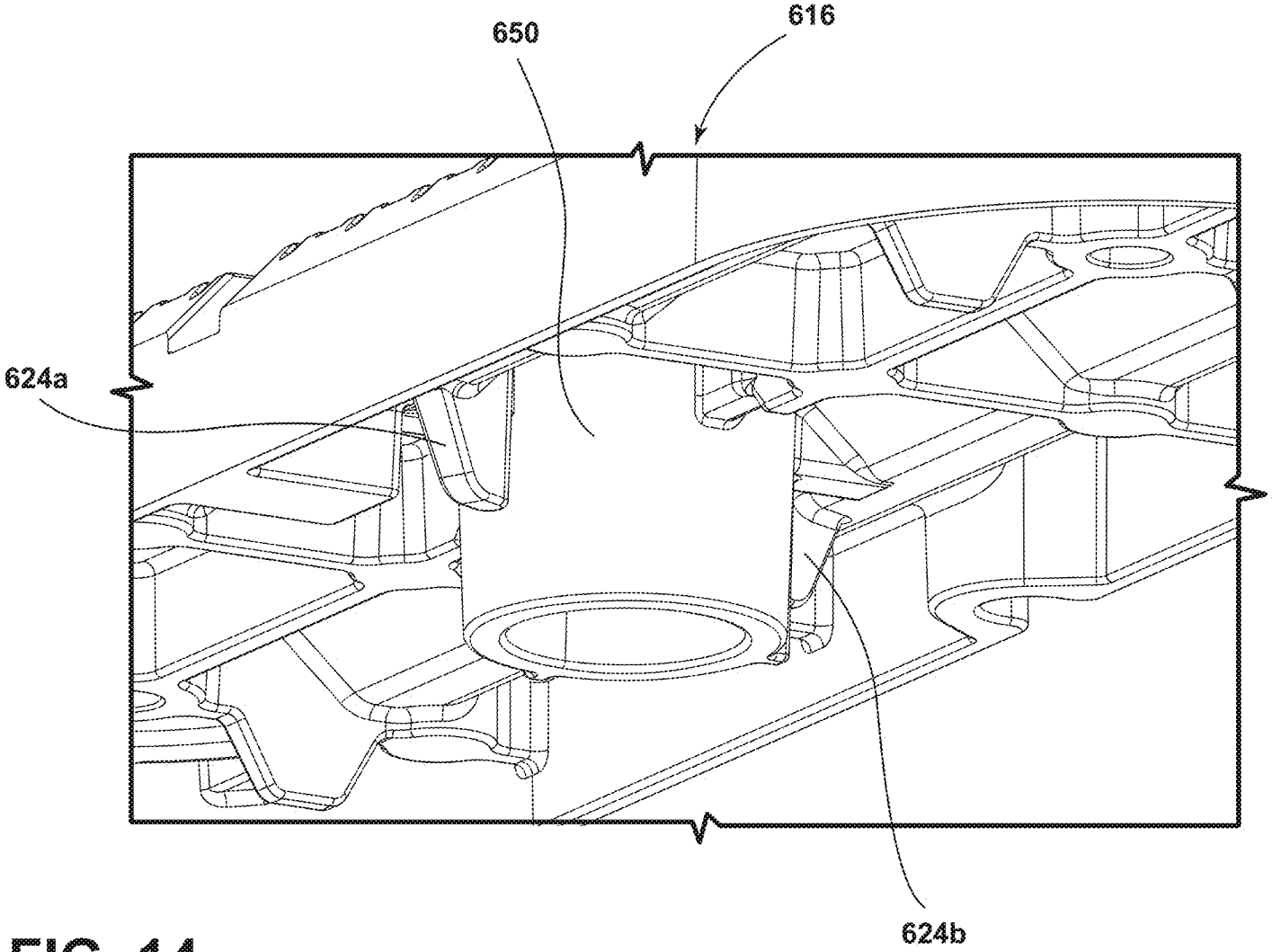
FIG. 14 is a partial bottom perspective view of the spreader of FIG. 13.

As shown in FIGS. 13 and 14 in still a further example, first and second projections 624*a*,624*b* may be opposingly adjacent first and second lobes 632,634, respectively (with similar features indicated by similar numbers increased by 600). Each of the first and second projections 624*a*,624*b* may be disposed opposingly adjacent either the first or second side 684,686 of the first and second lobes 632,634, where the first and second sides 684,686 are defined by the radial axes 682 of the first and second lobes 632,634, respectively. Additionally, the first and second projections 624*a*,624*b* may be oppositely disposed relative the stem 650. Further, it is generally contemplated that the projections 624 may be diagonally disposed such that, by way of example, the first projection 624*a* is opposingly adjacent the first side 684 of the first lobe 632 and the second projection 624*b* is opposingly adjacent the second side 686 of the second lobe 634. Upon a force being applied to the spreader 616, the projections 624 brace against the respective lobes 630 (i.e., depending on the direction of the force), thus stabilizing the spreader 616 relative the cooktop 612 (FIG. 2) and preventing unwanted rotation of the spreader 616 with relation to the holder 626 and, accordingly, the cooktop 612.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A gas burner for a cooktop comprising:

a spreader extending along a major axis to define an elongated shape with an outer perimeter, the spreader further defining an underside inward of the outer perimeter and including a stem centrally disposed on the underside, a first projection, and a second projection each defining a vertical contact surface and extending away from the underside at separate, spaced-apart locations therea long, the spaced apart locations each being spaced inward from the outer perimeter and radially adjacent the stem, wherein the stem defines an inlet open through the spreader, and an exterior that includes a fin opposite the inlet; and an orifice holder having a body defining a cavity and a first lobe and a second lobe extending radially outward from and between first and second side surfaces of the body opposite the cavity, the contact surfaces of the first and second projections being positioned opposingly adjacent and coupled to at least one of the first and second lobes in an axial direction with respect to the body and positioned outside of the body, the body receiving the stem therein within the cavity and defining a groove in which the fin of the stem is disposed.

2. The gas burner of claim 1, wherein:

the first and second lobes of the orifice holder extend radially from the body along respective radial axes that divide each of the first and the second lobes into respective portions with at least respective first and second sides; and the first and second projections are opposingly adjacent the respective first and second sides.

3. The gas burner of claim 1, wherein the first projection and the second projection are opposingly adjacent the first lobe and the second lobe, respectively.

4. The gas burner of claim 1, wherein:

the first and second projections are opposingly adjacent the first lobe; and the spreader further includes a third projection and a fourth projection extending away from the underside and opposingly adjacent the second lobe.

5. The gas burner of claim 4, wherein:

the first and second lobes extend radially outward along a radial axis that bisects the body into first and second side surfaces and further divides each of the first and the second lobes into respective portions with at least respective first and second sides;

the first and third projections are positioned adjacent the first side of the first and second lobes, respectively; and the second and fourth projections are positioned adjacent the second side of the first and second lobes, respectively.

6. The gas burner of claim 1, wherein the first projection and the second projection are opposingly adjacent the first lobe and the second lobe on respective facing sides thereof.

7. The gas burner of claim 1, wherein:

the first and second projections are opposingly adjacent the first lobe; and the spreader further defines a third projection opposingly adjacent the second lobe with respect to either of the first and second projections.

8. A burner for a cooktop comprising:

a spreader defining an outer perimeter and an underside inward of the outer perimeter, having a plurality of transverse ribs and including a stem, a first projection and a second projection, the stem defining an inlet opening that extends through the spreader, and an exterior opposite the inlet opening, the stem, the first projection, and the second projection each defining a vertical contact surface, extending away from the underside, wherein the first and second projections are spaced inward from the outer perimeter and radially adjacent and spaced from the exterior of the stem, wherein the first projection is integrally formed with and extends from an end of at least one of the plurality of transverse ribs; and a holder including a body defining a cavity and at least one lobe extending radially outward from the holder opposite the cavity and along a radial axis defining a first side and a second side of the at least one lobe, the holder being mutually engageable with the spreader at least during operation of the burner including by positioning the contact surfaces of the first and second projections opposingly adjacent and coupled to the at least one lobe in an axial direction with respect to the body and by receipt of the stem of the spreader within the cavity of the body.

9. The burner of claim 8, wherein:

the first projection is positioned on the first side of the at least one lobe; and the second projection is positioned on the second side of the at least one lobe.

10. The burner of claim 8, wherein the at least one lobe includes a first lobe and a second lobe extending along respective radial axes, the radial axes defining first and second sides of the first and second lobes, respectively.

11. The burner of claim 10, wherein:

the first projection is positioned on the first side of the first lobe; and the second projection is positioned on the second side of the second lobe.

12. The burner of claim 10, wherein the spreader further includes a third projection, the third projection opposingly adjacent the second lobe with respect to one of the first or second projections.

13. The burner of claim 12, wherein:

the first projection is positioned on the first side of the first lobe;

the second projection is positioned on the second side of the first lobe and opposingly adjacent the first lobe with respect to the first projection; and the third projection is opposingly adjacent the second lobe with respect to one of the first or second projections.

14. The burner of claim 13, wherein the spreader further includes a fourth projection, the fourth projection opposingly adjacent the second lobe with respect to the third projection.

15. A cooktop comprising:

an upper housing defining an exterior, an interior, and an aperture;

a spreader positioned on the upper housing and defining an outer perimeter and an underside inward of the outer perimeter and resting on the exterior of the upper housing and including a plurality of projections, each defining a vertical contact surface and extending away from the underside at separate, spaced-apart locations therealong, the spaced-apart locations each being spaced inward from the outer perimeter and aligned with the aperture of the upper housing; and a holder rigidly affixed on the interior of the upper housing and including at least one lobe extending radially outward from the holder along a radial axis that divides the at least one lobe into a first side and a second side, the holder being mutually engageable with the spreader by positioning of the plurality of projections adjacent the at least one lobe through the aperture, wherein the contact surface of at least one projection of the plurality of projections defines a single contact point with the at least one lobe within an apex region of the at least one lobe during operation of the cooktop.

16. The cooktop of claim 15, wherein the plurality of projections are opposingly adjacent the at least one lobe.

17. The cooktop of claim 15, wherein the at least one lobe includes a first lobe and a second lobe, the first and second lobes respectively extending radially outward from the holder along respective radial axes defining the first and second sides of the first and second lobes, respectively.

18. The cooktop of claim 17, wherein:

the plurality of projections includes a first projection and a second projection;

the first projection is mutually engageable with the apex region of the first lobe; and the second projection is adjacent the first lobe and one the second side of the first lobe.

19. The cooktop of claim 18, wherein:

the plurality of projections further includes a third projection and a fourth projection; and the third and fourth projections are opposingly adjacent the second lobe on the first side and the second side of the second lobe, respectively.

20. The cooktop of claim 17, wherein at least two of the plurality of projections are opposingly adjacent the first lobe and the second lobe, respectively.

* * * * *